United States Patent [19]

Plasko

[11] 3,931,602

[45] Jan. 6, 1976

[54] THERMAL LIMITER FOR ONE OR MORE ELECTRICAL CIRCUITS AND METHOD OF MAKING THE SAME

[75] Inventor: Emil Robert Plasko, Washington Township, Ohio

[73] Assignee: Micro Devices Corporation, Dayton, Ohio

[22] Filed: Feb. 24, 1975

[21] Appl. No.: 552,668

Related U.S. Application Data

[60] Continuation-in-part of Ser. No. 490,732, July 22, 1974, which is a division of Ser. No. 321,753, Jan. 8, 1973, Pat. No. 3,839,692, which is a continuation-in-part of Ser. No. 217,927, Jan. 14, 1972, Pat. No. 3,764,948, which is a continuation-in-part of Ser. No. 101,848, Dec. 28, 1970, Pat. No. 3,649,942, which is a continuation-in-part of Ser. No. 62,369, Aug. 10, 1970, abandoned.

[52] U.S. Cl. ..... 337/163; 337/166; 337/186; 337/222

[51] Int. Cl.[2] ..... H01H 85/02

[58] Field of Search ..... 337/163–165, 337/182, 186, 222; 219/501

[56] References Cited

UNITED STATES PATENTS

| | | | |
|---|---|---|---|
| 1,361,396 | 12/1920 | Mooers et al. | 337/184 |
| 2,672,542 | 3/1954 | Fisher | 337/163 X |
| 3,764,948 | 10/1973 | Plasko | 337/163 |

FOREIGN PATENTS OR APPLICATIONS

| | | |
|---|---|---|
| 417,732 | 2/1967 | Switzerland |

*Primary Examiner*—J. D. Miller
*Assistant Examiner*—Fred E. Bell
*Attorney, Agent, or Firm*—Biebel, French & Bugg

[57] ABSTRACT

This invention relates to a self-contained thermal limiter construction which can be used to limit one or more electrical circuits and comprises a thermally responsive device having leads for being interconnected into such electrical circuit or circuits and one or more of electrically operated heaters disposed adjacent the device and each being adapted to cause the device to open the circuit or circuits when heated by the respective heater a certain amount.

2 Claims, 39 Drawing Figures

THERMAL LIMITER FOR ONE OR MORE ELECTRICAL CIRCUITS AND METHOD OF MAKING THE SAME

This application is a Continuation-in-Part application of its copending parent patent application, Ser. No. 490,732, filed July 22, 1974, which in turn, is a divisional application of its copending parent patent application, Ser. No. 321,753, filed Jan. 8, 1973, now U.S. Pat. No. 3,839,692, which, in turn, is a continuation-in-part application of its copending parent application, Ser. No. 217,927, filed Jan. 14, 1972, now U.S. Pat. No. 3,764,948, which, in turn, is a continuation-in-part application of its copending parent application, Ser. No. 101,848, filed Dec. 28, 1970, now U.S. Pat. No. 3,649,942, which in turn, is a continuation-in-part application of its copending parent application, Ser. No. 62,369, filed Aug. 10, 1970, and abandoned in favor of its continuation-in-part application, all of which are assigned to the same assignee to whom this application is assigned.

This invention relates to a thermal limiter construction for one or more electrical circuits and to method for making such a construction or the like.

For example, one embodiment of the thermal limiter construction of this invention can be used to limit multiple circuits in which a primary circuit energizes or controls one or more secondary circuits, such as a transformer having a primary circuit and secondary circuits. The limiter construction of this invention is a unitary construction which can be connected to such primary and secondary circuits in an efficient manner.

One feature of this invention is to provide a thermal limiter construction having a controlled delay action in the operation thereof to prevent accidental circuit limiting, such controlled delay action being provided by a fixed and controlled location of the heater element or elements relative to the limiter sensing element as will be apparent hereinafter.

In addition, other features of the limiter construction of this invention is to permit the selection of the heater element in its output temperature, the selection of the sensing element for the required sensed temperature for opening the circuit, and the selection of the desired characteristics of the insulating mass that secures the limiter parts together, such characteristics being the thermal conductivity of the mass material, the size of the mass utilized, etc. Other selectable variables of the limiter construction of this invention will be apparent hereinafter.

For example, one embodiment of a thermal limiter construction of this invention for at least one electrical circuit comprises a thermally responsive fuse and lead means operatively interconnected to the fuse for coupling the fuse in a desired electrical circuit. An electrical circuit heater means is disposed in a selected position relative to the fuse and an insulating mass covers and secures the heater means and the fuse in such selected position thereof with the lead means having at least portions thereof exposed from the mass whereby the insulating mass and the selected positioning of the heater means relative to the fuse, once the desired variables of the fuse, mass and heater have been selected, provides a controlled time delay in the heater means being adapted to cause the fuse to blow and thereby open the one electrical circuit.

Another thermal limiter construction of this invention can be of the above type except that the insulating mass can be eliminated or only be utilized to secure one of the fuse and heater therefor in the selected position thereof.

Another such thermal limiter construction of this invention has a plurality of electric circuit heater means disposed in selected positions on the fuse and being in different spaced relations relative thereto by the insulating mass which covers and secures the heater means and the fuse in such selected positions thereof while the lead means for the fuse and the heater means have portions thereof exposed from the insulating mass for interconnection to desired electrical circuits. If desired, such heater means can comprise heater wires coiled about the fuse in different stratified layers thereon.

Another thermal limiter construction of this invention has a plurality of electrically operated heater means disposed adjacent the thermally responsive device with such heater means merely being supported in selected positions relative to the device by support means, with or without the previously described insulating mass, each heater means being adapted to cause the device to open an electrical circuit coupled thereto when the device is heated by the respective heater means a certain amount.

This invention also includes a method of making the thermal limiter construction of this invention.

Many other features, advantages and objects will become obvious from this description, the appended claimed subject matter, and the accompanying drawings in which:

Figure 1:
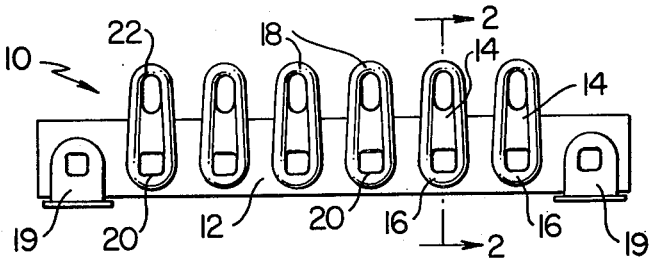
FIG. 1 is a side view of a plural circuit wire attachment toothed comb or comblike member to be used in this invention.

While the various features of this invention are hereinafter described as being particularly adapted to provide a thermal limiter construction for various specific systems, it is to be understood that the various features of this invention can be utilized singly or in any combination thereof to provide thermal limiter construction for any suitable system as desired.

Therefore, this invention is not to be limited to only the embodiments illustrated in the drawings as the drawings are merely utilized to illustrate some of the wide variety of uses of this invention.

Figure 2:
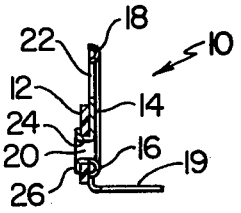
FIG. 2 is a cross section along the line 2—2.
Figure 3:
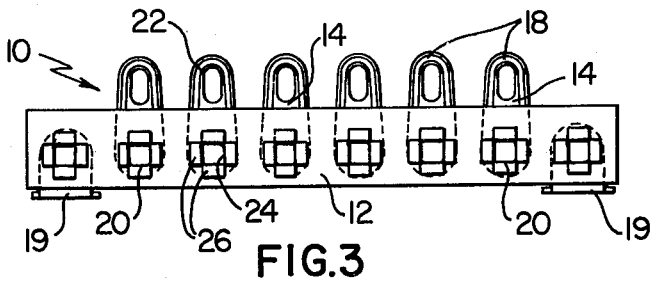
FIG. 3 is an opposite side view of FIG. 1.

Referring now the the drawings, a plural circuit wire attachment toothed comb or comblike member 10, FIGS. 1, 2 and 3, may be an article of manufacture now on the market and may have an electrically insulative base 12 carrying a plurality of electrically conductive wire attachment teeth or lead means 14. These teeth 14 may have wire attaching base supported tooth ends 16 secured to the base 12. The teeth 14 may also have wire attaching free tooth ends 18 extending away from said base 12.

The base 12 may be a relatively rigid insulative board strip made of any suitable material.

The wire attachment teeth 14 may have wire attachment openings 20 embedded in said insulative base 12 and other wire attachment openings 22 at the free ends of the teeth.

The base 10 may be a stiff insulative strip of any suitable material to which the base supported tooth ends 16 are secured by hollow rivets 24. These hollow rivets may be square tubes punched out of the tooth ends 16 so that the tubes pass through the strip 10 and have their punched ends formed into rivets with outward tongues 26 for attachment of circuit wires thereto. The free ends 18 of the teeth may have the wire attachment openings 22 punched therein.

Suitable L-shaped support brackets 19 may be similarly riveted to the board strip or base 12.

Figure 4:
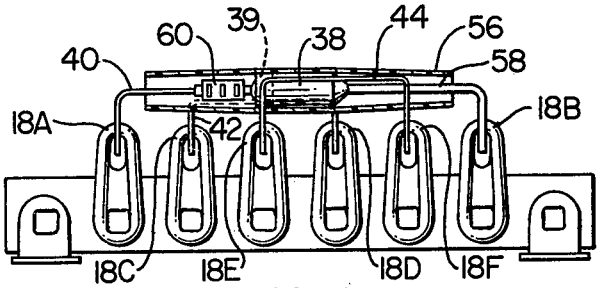
FIG. 4 is a view showing a partial assembly in the production of this invention and showing circuit wires secured to the free ends of the teeth of the comb members and with a thermally responsive fuse supported by two of said circuit wires.
Figure 5:
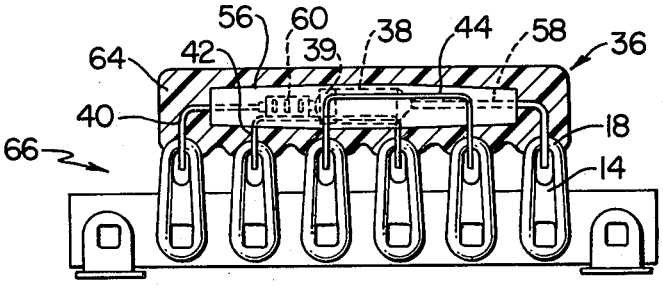
FIG. 5 is a view similar to FIG. 4, but showing a completed form of the invention.
Figure 5A:
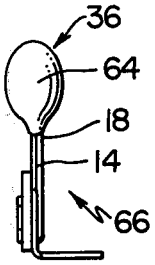
FIG. 5A is an end view of FIG. 5.

The article shown in FIGS. 1, 2 and 3 may be used in making the multiple circuit limiter shown in FIGS. 4, 5 and 5A which is suitable for simultaneously limiting or breaking multiple circuits such as the primary circuit 28 of a transformer arrangement 30 and one or more secondary circuits 32 and 34 of the transformer arrangement 30, which transformer may be a transformer for a television set.

The multiple circuit limiter or breaker shown in FIG. 5 may include an insulative coating structure 36 which covers and separates the various circuit wires which are mounted on the free ends 18 of the teeth 14. Such structure 36 may also cover a thermal fuse 38 and other parts to be described. The fuse 38 may be of the thermally collapsible pellet type with the pellet 39 at one end of the fuse, such as disclosed in P. E. Merrill U.S. Pat. No. 3,180,958, patented April 1965. The result is that the mass 36 may be heated by any one of the heating wires 40, 42 and 44 so that the heated mass 36 causes the thermal fuse 38 to open or blow the primary circuit 28 of the transformer 30 and thereby also deenergize the secondary circuits 32 and 34 and prevent damage to the transformer arrangement or the like.

It may be that one or more other secondary circuits 46 may be energized by the primary circuit 28 of transformer 30. However, such secondary circuit 46 may be of such current characteristics that it cannot be embodied in the mass 36. Under such conditions, a separate circuit breaker 48 may be provided in the secondary circuit 46 which has a thermal fuse 50. The wires 52 and/or pins 54 may be made with sufficient resistance to blow the fuse 50 and also break the one or more additional secondary circuits without breaking the transformer circuit arrangement previously described.

The insulative mass 36 may be formed as shown in FIGS. 4, 5 and 5A.

For example, any suitable insulative heat shrinkable sleeve 56, FIG. 4, may be placed around the fuse 38 and the circuit wires 40 and 58 also partly inside the sleeve 56 and extend out of said sleeve. The circuit wire 40 may be electrically resistive sufficiently to blow the fuse 38 when wire 40 is overloaded. The wire 58 is sufficiently conductive not to blow the fuse. A substantially electrically nonresistive splice 60 may connect wire 40 and fuse 38. The collapsible pellet 39 is sufficiently close to the heating wire 40 to be blown if the wire 40 is overloaded.

Thereafter, the ends of the wires 40 and 58 may be secured to the free tooth ends 18A and 18B.

Then a heating circuit wire 42 is placed adjacent to and outside the sleeve 56 and is secured to free tooth ends 18C and 18D so that the main body of heating wire 42 is sufficiently close to fuse 38 to blow the fuse if the wire 42 is overloaded.

Thereafter, a heating circuit wire 44 is placed adjacent to and outside sleeve 56 and also spaced from wire 42, but with its main body adjacent the fuse 38 sufficiently close to the fuse to blow the same if the wire 42 is overloaded. The ends of the wire 44 are secured to the free tooth ends 18E and 18F.

The insulative sleeve 56 may be made of any suitable heat shrinkable polyester such as mylar which is wrapped around parts of the wires 42 and 58 and is then lightly heat shrunk, if desired.

The assembly, as so far assembled in FIG. 4, is then dipped in any well known ceramic or epoxy cement to form the insulative mass 64 around the sleeve 56 and around the wires 40, 42, 44 and 58. The mass 64 may be somewhat oblong when viewed transversely, as in FIG. 5A, with parts extending to cover substantially all of said wires 40, 42, 44 and 58 and the free ends 18A, 18B, 18C, 18D and 18E of the comb teeth. In this manner, the solidified mass 64 holds the heating wires, 40, 32 and 34 in a fixed position relative to the pellet 39 of the fuse 38 for a purpose hereinafter set forth.

Figure 6:
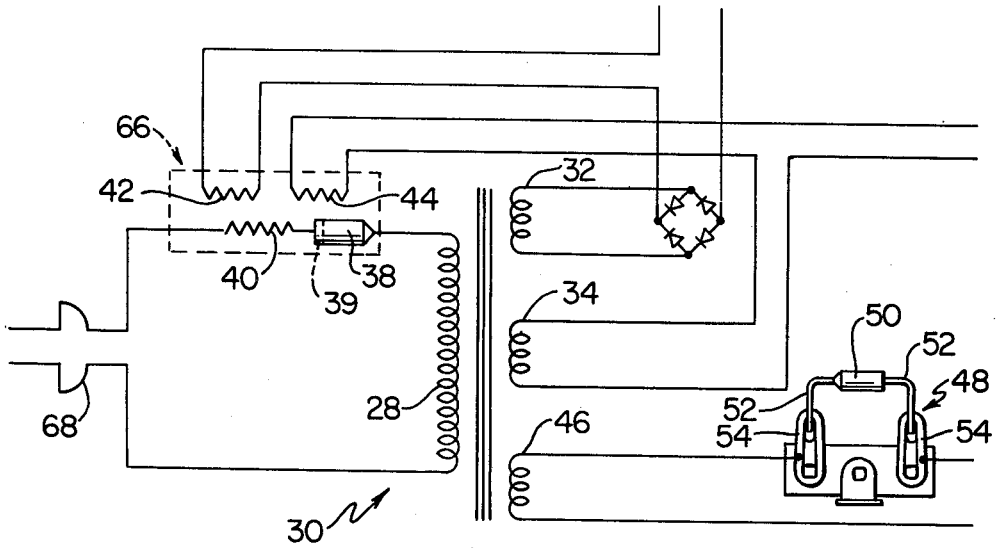
FIG. 6 is a diagrammatic view of the invention used as a multiple circuit temperature limiter in the circuit wires of a part of a transformer circuit.
Figure 7:
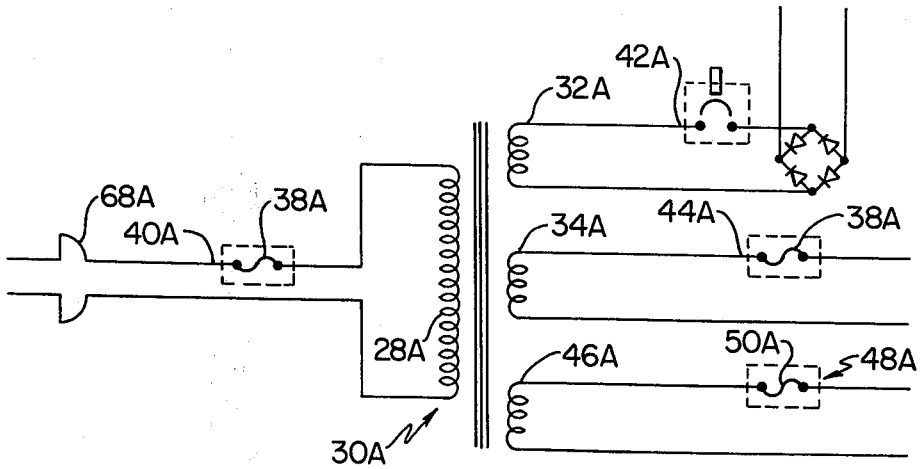
FIG. 7 is a diagrammatic view showing a transformer circuit somewhat similar to the circuit of FIG. 6 but in which the temperature is limited by separate limiters which can be eliminated by this invention.

FIG. 7 shows a transformer circuit somewhat similar to that shown in FIG. 6. However, the limiters in FIG. 7 are individual to their respective primary and secondary circuits. These limiters have been individually mounted within the television cabinet or the like in a manner to require experienced service means to provide service on the parts rather than permit the owner to try and correct a blown circuit by mere fuse replacement and not correct service on the malfunctioning part.

The parts on the circuit of FIG. 7 have been marked with reference numerals of FIG. 6 to indicate how the parts are unified by this invention.

In FIG. 6, the transformer primary circuit may be connected to a plug-in structure 68 so that the primary circuit energizes a plurality of secondary circuits 32, 34 and 46, or more.

The finished product shown in FIG. 5 may be placed anywhere in the primary circuit so that all the heater wires 40, 42 and 44 can heat the insulative mass 64 which acts as a heat sink in a controlled manner to cause the fuse 38 to blow if any of the heater wires are overloaded.

In particular, the position of the heating wires 40, 32 and 34 as held by the mass 64 in relation to the pellet 39 of the fuse as well as the heat conductive characteristics of the mass 64 are so selected that the fuse 38 will not immediately blow but will blow only after a certain time period from the initial heating of one or more wires 40, 32 and 34 and the continued heating thereof in order to prevent inadvertent blowing of the fuse 38 should the serviceman accidently cause a temporary short circuiting by a screwdriver engagement during a service check, etc.

Any isolated secondary circuit such as 46 can be broken by an individual thermal fuse or current breaker 48.

Thus, it is to be seen that this invention includes an improved multiple circuit thermal limiter 66, FIG. 5, which can be combined with a multiple circuit such as a transformer circuit as shown in FIG. 6. An efficient method of making such limiter is also provided.

Figure 13:
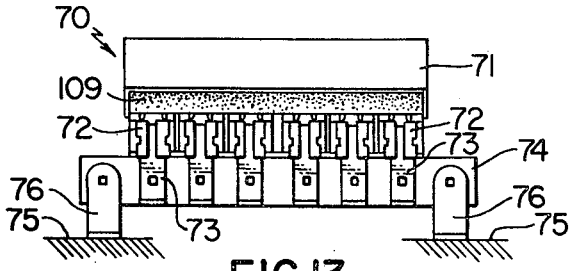
FIG. 13 is a side view of the completed multiple circuit thermal limiter of this invention as coupled to a plural circuit wire lead attachment means.
Figure 15:
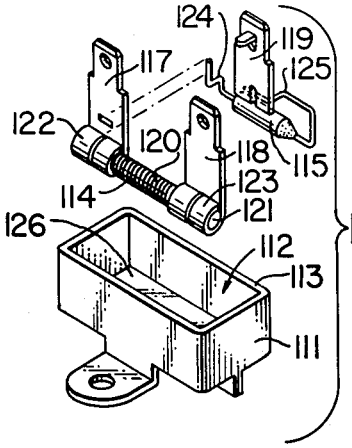
FIG. 15 is an exploded perspective view of the various parts forming the thermal limiter of FIG. 14.

Another multiple circuit thermal limiter of this invention is generally indicated by the reference numeral 70 in FIG. 13 and comprises a housing means or base 71 formed of suitable insulating material and carrying a plurality of quick connect and disconnect sleeve-like lead members 72 for effectively receiving bayonet type lead strips 73 carried on an electrically insulating base or strip 74 adapted to be mounted to a desired supporting structure 75 by suitable leg means 76 whereby the thermal limiter 70 of this invention is adapted to be coupled to the lead attachment strips 73 of the board or vase 74 by merely having the lead sleeves 72 telescoped over the projecting portions of the lead strips 73 so that the thermal limiter 70 of this invention can be coupled into a desired circuit means interconnected to the lead strips 73 in a conventional manner.

Figure 8:
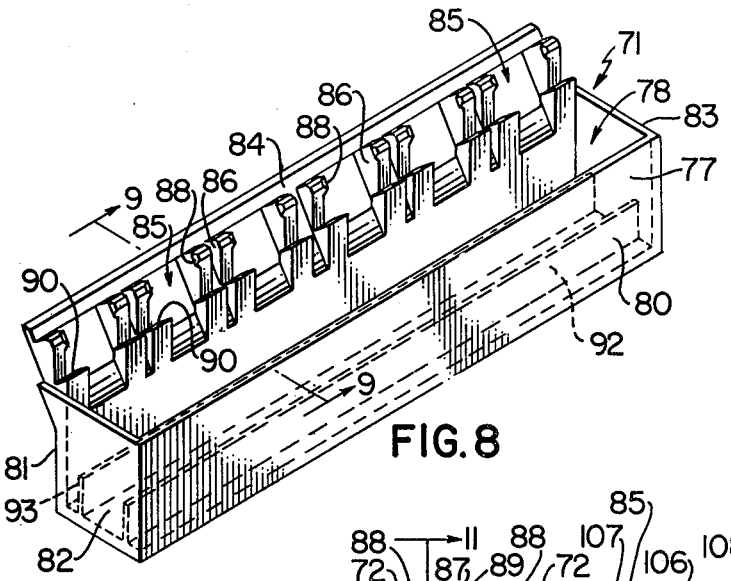
FIG. 8 is a top perspective view of a housing structure for another multiple circuit thermal limiter of this invention.
Figure 9:
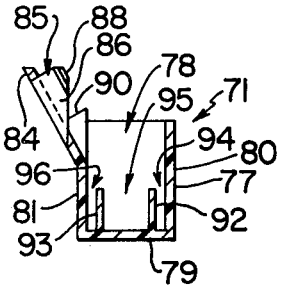
FIG. 9 is a cross-sectional view taken on line 9—9 of FIG. 8.
Figure 10:
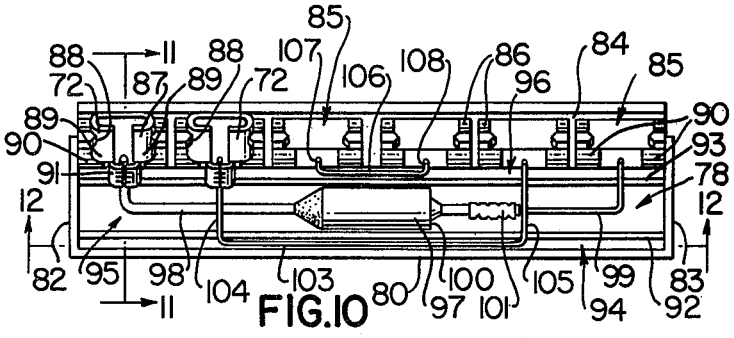
FIG. 10 is a top view of the housing structure illustrated in FIG. 8 and illustrates the fuse, heater wires and terminals assembled therein.

The multiple circuit thermal limiter 70 of this invention has the housing means 71 thereof provided with a substantially rectangular base portion 77 with a cavity 78 formed therein and defining a closed end wall means 79, opposed side wall means 80 and 81 and opposed end walls 82 and 83 of the housing means 71 with the side wall 81 having an extension 84 angled therefrom in the manner illustrated in FIGS. 8, 9 and 10. The angled wall 84 has a plurality of pockets 85 formed therein and defined between outwardly extending ridge means 86 utilized for snap fitting and retaining the sleeve-like lead means 72 in a pre-assembled position relative thereto.

Figure 12:
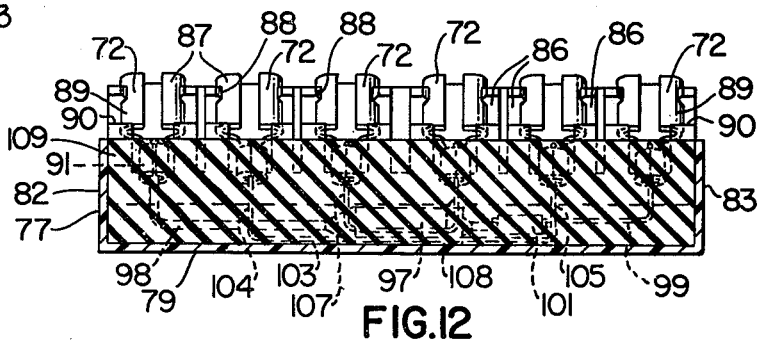
FIG. 12 is a cross-sectional view taken on line 12—12 of FIG. 10 and illustrates the structure of FIG. 10 after the insulating mass has been received in the housing means.

For example, each lead means 72 comprises an upper sleeve-like portion 87 adapted to slip into a pocket means 85 under inwardly directed ears 88 of the cooperating ridge means 86 so as to be held flat against the angled wall 84 with the lower end 89 of the sleeve 87 abutting against locating shoulder means 90 on the ridge means 86 as illustrated in FIG. 12 whereby a lower wire attaching means 91 of the lead means 72 extends into the chamber or recess 78 of the housing means 71. In this manner, the sleeve-like lead means 72 of the thermal limiter 70 can be disposed in the pocket means 85 of the housing means 71 so that the same will be uniformly positioned relative thereto by the stop means or shoulders 90 and ears 88 of the ridge means 86 whereby the sleeve-like lead means 72 will be in proper positions relative to the lead strips 73 of the insulating base 74 when it is desired to couple a thermal limiter 70 of this invention thereto.

If desired, the spacing between the pockets 85 on the angled side wall 84 of the housing means 71 can be so spaced relative to each other that the same will be compatible with like spacing of the strips 73 on the insulating board 74 so that the thermal limiter 70 can be only coupled to the strips 73 on the board 74 when the limiter 70 is held in a certain position relative thereto so that wrong connecting to the board 74 will be prevented. For example, it can be seen that the spacing between the middle two sleeve members 72 of the thermal limiter 71 of this invention is greater than the spacing between any other adjacent pair of lead means 72 so as to be compatible with like spacing between the lead strips 73 on the base 74.

Figure 11:
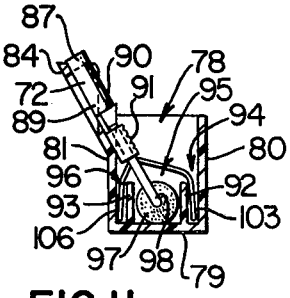
FIG. 11 is a cross-sectional view taken on line 11—11 of FIG. 10.

The end or bottom wall 79 of the housing means 71 of the thermal limiter 70 has upwardly extending longitudinal dividers 92 and 93 formed integrally therewith and dividing the recess 78 into three chambers 94, 95 and 96 as illustrated in FIG. 11 whereby the chamber 95 is adapted to receive a temperature responsive fuse 97 formed in the same manner as the fuse 38 previously described and be electrically interconnected to the two outboard lead means 72 by supporting wires 98 and 99 as illustrated in FIG. 10, the wire 99 being a heater wire in the same manner as the heater wire 40 previously described and being coupled to the right side 100 of the fuse 97 by a substantially electrically non-resistive splice member 101 in the same manner as the splice member 60 previously described.

A heater wire 103 can be disposed in the chamber 94 and have its opposed ends 104 and 105 respectively interconnected to the next two inboard lead means 72. Another heater wire 106 is adapted to be disposed in the chamber 96 and have its opposed ends 107 and 108 respectively interconnected to the two innermost lead sleeves 72 as illustrated in FIGS. 10 and 12.

In this manner, it can be seen that the dividers 92 and 93 separate the heating wires 103 and 106 from the thermal fuse 97 as well as the lead attachment wires thereof during the assembly operation as illustrated in FIG. 10.

Thereafter, the desired insulative mass 109 is disposed in the recess 78 of the housing means 71 to fill the same to the desired level, which in the embodiment illustrated in the drawings is to the top of the end walls 82 83 and side walls 77, so as to not only cover and secure the heating wires 99, 103 and 106 in the desired selective positioning thereof relative to the fuse 97 when the mass 109 hardens, but also to cover the lower ends 91 of the lead means 72 so as to secure the lead means 72 in their assembled relation in the pockets 85 so that the same cannot be subsequently moved relative to the housing means 71.

In this manner the completed thermal limiter 70 of this invention is adapted to be coupled to the lead board 74 in the manner previously described and be uncoupled thereto by merely telescoping or untelescoping the sleeve means 70 thereof to or from the lead strips 73 of the board 74 in a simple and effective manner.

Thus, it can be seen that the thermal limiter 70 of this invention is adapted to have the fuse 97 thereof open a circuit connected to the outermost pair of terminals 72 thereof when any one of the heating means 99, 103 and 106 generates sufficient heat to be conducted to the fuse 97 by the thermal mass 109 to cause the fuse 97 to blow, it being understood that the selection of the positioning of the heating wires relative to the fuse 97 as well as the conductive characteristics of the mass 109 are so selected that accidental blowing of the fuse 97 will not take place until the overloaded or short circuited condition is in existence for a length of time which would require a circuit opening.

If desired, the thermal limiter 70 can be utilized in the same manner as the thermal limiter 66 previously described or in other circuit means for like purposes.

Another thermal limiter or thermal limiter construction of this invention is generally indicated by the reference numeral 110 in FIG. 14 and comprises an electrically insulating housing means or base 111 having a recess 112 interrupting the top surface 113 thereof and receiving a heating means 114 and a thermal fuse 115 therein to be selectively positioned therein and subsequently covered and secured in such selective positioning by suitable insulating means or mass 116 so that three lead means 117, 118 and 119 respectively extend outwardly from the mass 116 for coupling circuit 127 is adapted to be utilized for an air conditioner or the like wherein an electrically operated drive clutch 128 is provided for the compressor and is adapted to have its side 129 interconnected to a suitable power source 130 by a lead means 131 interconnected by the conventional air conditioning on-and-off temperature responsive switch 132 to the terminal 119 of the thermal limiter 110 of this invention while the other terminal 117 thereof is interconnected by a lead 133 to the side 129 of the clutch means 128. The other side 134 of the clutch means 128 is interconnected by a lead 135 to ground in the same manner that the other side of the source 130 is interconnected to ground.

The terminal 118 of the thermal limiter 110 is interconnected to a loss-of-charge sensor switch 136 which is in normally open condition as long as there is no loss of refrigerant of the air conditioning unit utilizing the circuit 127.

Thus, it can be seen that the electrically operated clutch means 128 is adapted to function as long as the switch 136 is in an open condition since the clutch means 128 is placed across the power source by the thermal limiter 110 of this invention when the switch 132 is closed to demand that the compressor be operating.

Figure 19:
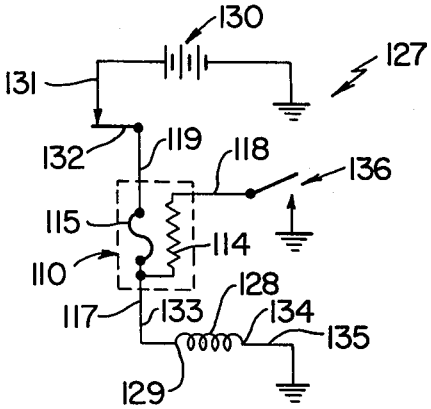
FIG. 19 is a schematic view illustrating an electrical circuit which can be utilized in combination with the thermal limiter of FIG. 14.

However, if the loss-of-charge switch 136 closes due to the refrigerant escaping from the refrigerant system, the compressor would burn out within a few minutes because the same would not receive sufficient lubrication whereby the heating means 114 now operatively interconnected to the source 130 will heat up sufficiently to cause the fuse 115 to blow and, thus, open the circuit that operates the clutch 128 so that the clutch 128 can no longer operate until the thermal limiter 110 in a desired circuit, such as the electrical circuit illustrated in FIG. 19 and hereinafter described.

The heating means 114 includes a heating wire 120 mounted on a rod 121 and has its opposed ends respectively interconnected to the terminals 117 and 118 having the lower portions 122 and 123 thereof disposed in coiled fashion about the rod 121 to be rigidly secured thereto.

Figure 16:
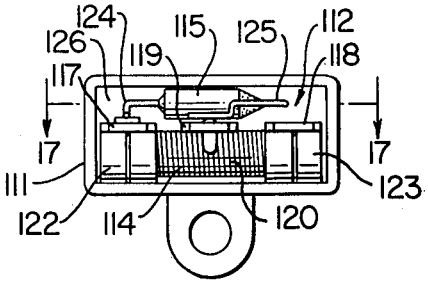
FIG. 16 is a top view of the parts of FIG. 15 in their assembled position and before the insulating mass has been disposed in the housing thereof.
Figure 18:
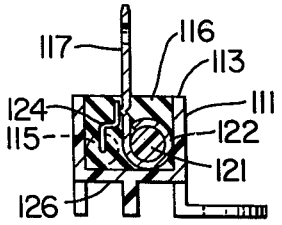
FIG. 18 is a cross-sectional view taken on line 18—18 of FIG. 17.

The thermal fuse 115, similar to fuse 38 previously described, has opposed lead wires 124 and 125 extending therefrom with the lead wire 125 being secured to the terminal means 119 and with the lead wire 124 being interconnected to the terminal 117 as illustrated, the wires 124 and 125 being of sufficient strength to support the fuse 115 in spaced relation relative to the heating means 114 in the manner illustrated in FIG. 16 when the same are disposed in the housing means 111 against a bottom wall means 126 thereof in the manner illustrated in FIG. 16 so that the insulating mass 116 can be subsequently disposed in the housing means 111 to cover and secure the fuse 115 and heating means 114 in the selected positioning thereof as illustrated, the insulating mass 116 being disposed between the fuse 115 and the heating means 114 as illustrated in FIG. 18 to provide insulation therebetween in the same manner as the divider walls 92 and 93 of the housing means 71.

Figure 14:
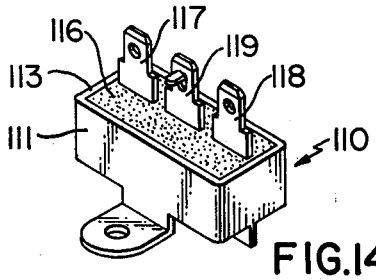
FIG. 14 is a top perspective view of another thermal limiter construction of this invention.
Figure 17:
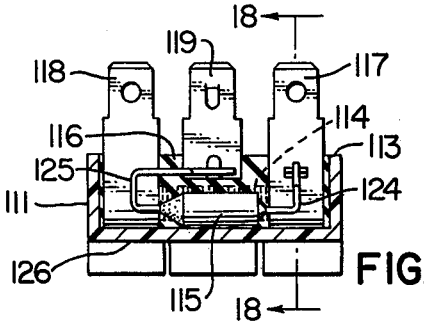
FIG. 17 is a cross-sectional view taken on line 17—17 of FIG. 16 and illustrates the thermal limiter after the insulating mass has been placed in the housing means of FIG. 16.

The thermal limiter 110 of FIG. 14 is adapted to be utilized in the particular electrical circuit 127 of FIG. 19 in a manner now to be described, but it is to be understood that the thermal limiter 110 can be utilized for other purposes as desired.

As illustrated in FIG. 19, the electrical thermal limiter 110 is replaced.

However, in a normally performing air conditioning system, the loss-of-charge switch 136 can close for a minute or so under some unusual weather conditions whereby it would not be desired for the thermal limiter 110 to blow and, thus, require a serviceman to replace the same before the air conditioner can be operated. Thus, the thermal limiter 110 of this invention has been so constructed and arranged in the positioning of the heating means 114 relative to the fuse 115 as well as in the selection of the thermal mass 116 to permit the loss-of-charge switch 136 to be temporarily closed only for a minute or so without causing the fuse 115 to blow during the unusual weather conditions, but will assure that the fuse 115 will blow should the loss-of-charge switch 136 be closed for a time short of an adverse situation wherein the compressor would burn out or the like.

Thus, it can be seen that the thermal limiter 110 of this invention is adapted to protect an air conditioning system in the manner illustrated in FIG. 9 through a controlled time delay thereof.

While the thermal limiter construction 110 has been previously described as having the insulating mass 116 completely covering and securing the fuse 115 and heater 120 in the selected positioning thereof for the reasons previously set forth, a similar self-contained thermal limiter construction could be provided wherein the insulating mass could be completely eliminated or the same can be utilized to merely secure one of the fuse 115 and the heating means 114 in the selected positioning thereof.

For example, such a modified thermal limiter construction is generally indicated by the reference numeral 110A in FIGS. 34–38 and parts thereof similar to the self-contained thermal limiter construction 110 of FIGS. 14–18 are indicated by like reference numerals followed by the reference letter "A".

As illustrated in FIGS. 34–38, the thermal limiter construction 110A is substantially identical to the thermal construction 110 previously described except that the cup-shaped housing 111A is substantially deeper than the housing 111 previously described and the terminals 117A, 118A and 119A are substantially longer and so constructed and arranged that the heater means 114A is adapted to be disposed in the housing 111A against the bottom wall 126A thereof and have the projecting portions of the terminals 117A and 118A extend out of the open end 113A of the housing 111A substantially the same distance that the terminals 117 and 118 of the thermal limiter construction 110 extend out of the housing 111 thereof so that the thermal limiter constructions 110A and 110 can be interchangeable in the system 127 of FIG. 19.

Figure 37:
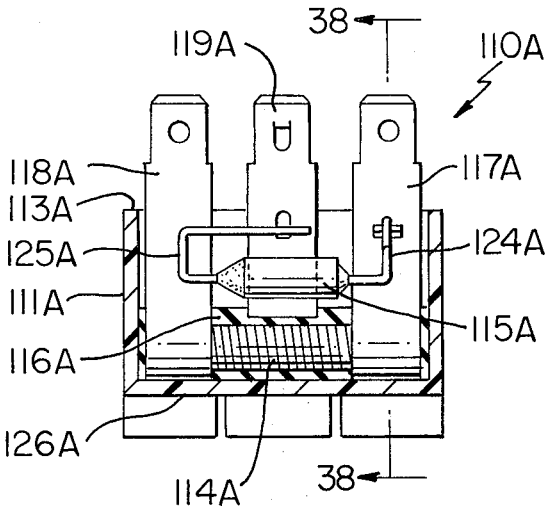
FIG. 37 is a cross-sectional view taken on line 37—37 of FIG. 36 and illustrates the thermal limiter construction in its completed form with the insulating mass included therein.
Figure 34:
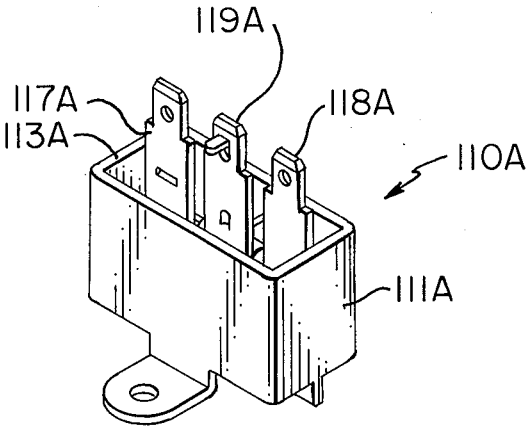
FIG. 34 is a view similar to FIG. 14 and illustrates another self-contained thermal limiter construction of this invention.
Figure 38:
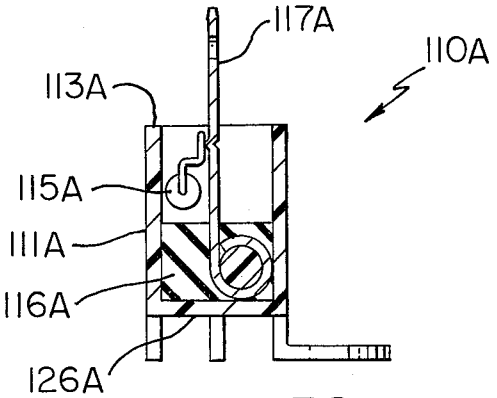
FIG. 38 is a cross-sectional view taken on line 38—38 of FIG. 37.

The fuse 115A has its lead wires 124A and 125A respectively secured to the terminals 117A and 119A in such a manner that the fuse 115A is supported in a selected position above the heater means 114A in the manner illustrated in FIGS. 37 and 38 so that subsequently an insulating mass 116A can be disposed in the housing 111A to completely cover and secure the heater means 114A in its selected position in the housing 111A as well as to secure the middle terminal 119A at the lower end thereof in its fixed aligned position with the other terminals 117A and 118A as illustrated in FIG. 37 so that the fuse 115A is disposed above the mass 116A but is held in its selected position relative to the heater means 114A by its lead wires 124A and 125A that are respectively secured to the terminals 117A and 119A that are respectively held in the assembled aligned relation with the terminal 118A by the insulating mass 116A as illustrated.

While the fuse 115A is disposed above the insulating mass 116A and, thus, out of contact therewith, it can be seen that the same is fully protected by the housing means 111A as the same is disposed below the top surface 113A of the housing 111A whereby the leads 117A, 118A and 119A can be utilized to couple the self-contained thermal limiter construction 110A in the system 127 of FIG. 19 in substantially the same manner as the terminals 117, 118 and 119 of the thermal limiter construction 110 for the previously described purpose. However, it is to be understood that the selected positioning of the heater means 114A and fuse 115A as well as the selection of the insulating mass 116A is such that the same will provide a controlled time delay in the opening of the fuse 115A during the energizing of the heater means 114A for the purposes previously set forth.

Accordingly, it can be seen that the thermal limiter constructions 110 and 110A of this invention are substantially self-contained units that respectively have the terminals 117–119 and 117A–119A disposed in aligned relation so that the thermal limiter construction 110 and 110A can be utilized interchangeably in a system constructed to respectively receive the terminals 117–119 and 117A–119A in their aligned relation as illustrated when it is desired to replace a blown unit 110 or 110A as the case may be.

Figure 20:
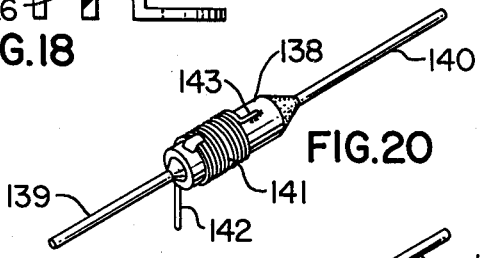
FIG. 20 is a perspective view of another thermal limiter of this invention before the same has been covered and secured in position by an insulating mass.
Figure 21:
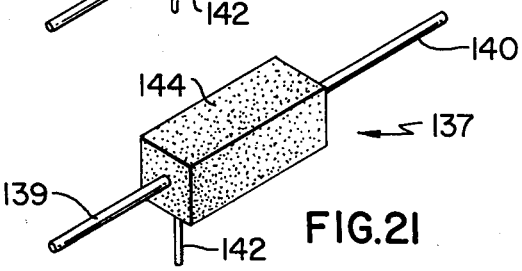
FIG. 21 illustrates the thermal limiter of FIG. 20 in its completed form after the insulating mass has been disposed thereon.

Another thermal limiter or thermal limiter construction of this invention is generally indicated by the reference numeral 137 in FIG. 21 and is formed of the parts illustrated in FIG. 20 wherein a thermal fuse 138, similar to the fuse 38 previously described, has opposed leads 139 and 140 extending from opposed sides thereof for completing a circuit therethrough and has a heating wire 141 coiled upon the same with the opposed ends 142 and 143 of the heating wire 141 so disposed that the lead 143 is coupled to the fuse 138 in the same manner as the lead wire 139 whereas the lead wire 142 extends away from the fuse 138 as illustrated.

Subsequently, an insulating mass 144, formed in any suitable shape, is disposed about the assembly illustrated in FIG. 20 so as to secure and cover the fuse 138 and heating wire 141 to hold the same in the selected positioning illustrated in FIG. 20 so that the lead means 139, 142 and 140 extend outwardly from the mass 144 for coupling into a desired circuit. For example, the thermal limiter 137 is adapted to be utilized in place of the thermal limiter 110 in FIG. 19 and serve the same function thereof wherein the lead 142 is interconnected to the loss-of-charge switch 136 and the leads 139 and 140 are adapted to be respectively interconnected to the on/off switch 132 and the electrical clutch 128.

While the device 137 previously described has only one heater wire 141 coiled thereon, it is to be understood that the fuse 138 could have a plurality of heater wires disposed thereon and be secured thereto and covered by the mass 144 in various selected positions relative to the device 138.

Figure 23:
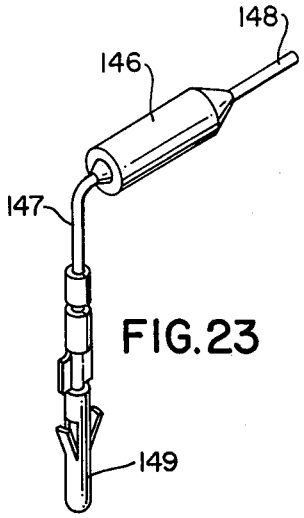
FIG. 23 is a perspective view of the fuse part of the device of FIG. 22.

For example, reference is now made to FIG. 22 wherein another thermal limiter or thermal limiter construction of this invention is generally indicated by the reference numeral 145 in FIG. 22 and is formed of various parts in the manner illustrated in FIGS. 23–29 and as hereinafter described wherein it can be seen that a thermal fuse 146 similar to the fuse 38 previously described has opposed leads 147 and 148 extending from opposed sides thereof in the manner illustrated in FIG. 23. The lead 147 can be interconnected to a plug-in type of lead member or element 149 which can be subsequently mounted in a suitable opening 150 of a plug-in terminal block 151 that can be coupled to other electrical leads in a plug-in manner that is well known in the art.

A sleeve 152 of insulating material such as plastic sheathing or the like, can be telescoped over the thermal fuse 146 in the manner illustrated in FIG. 24 so as to space a heater wire 153 subsequently coiled thereon from the fuse 146 a predetermined amount in the manner illustrated in FIG. 25. The coil 153 has one end 154 thereof coiled on the lead 148 so as to be in electrical connection therewith while the other end 155 of the coiled heater wire 153 is interconnected to another plug-in terminal element 156 to be received in a hole 157 of the terminal block 151. In this manner, it can be seen that the coiled part of the heater wire 153 is spaced from the thermal element 146 by the insulating sleeve 152 with the insulating sleeve 152 also electrically spacing the heater wire 153 therefrom. However, since the end 154 of the heater wire 153 is in electrical contact with the lead 148 of the thermal device 146, it can be seen that the heater wire 153 is disposed in series with the thermal fuse 146 by being disposed between the lead 156 and the thermal element 146 so that a circuit between the plug-in elements 149 and 156 includes the thermal element 146 and heater wire 153 in series.

Figure 25:
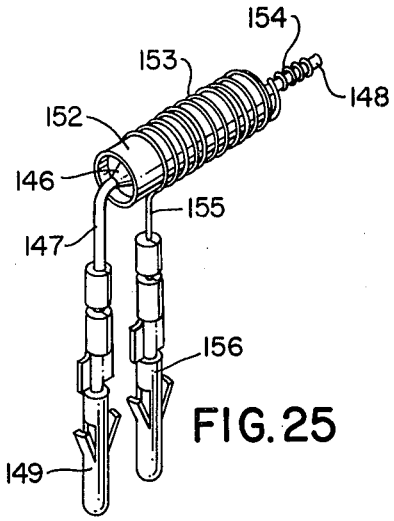
FIG. 25 is a perspective view of the device of FIG. 24 with a first heater coil coiled on the insulating sleeve of the fuse.
Figure 26:
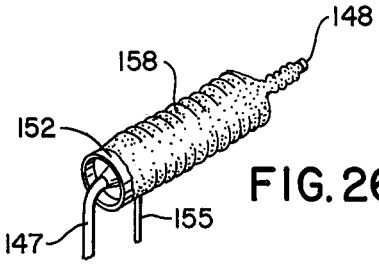
FIG. 26 is a perspective view similar to FIG. 25 and illustrates the first heater wire being covered by an insulating mass.

After the heater wire 153 has been coiled on the thermal fuse 146 in the manner illustrated in FIG. 25, an insulating mass 158 is disposed on the assembly of FIG. 25 in the manner illustrated in FIG. 26 to completely cover the coiled portion of the heater wire 153 on the sleeve 152 as well as to completely cover and insulate the interconnection between the coiled end 154 of the heater wire 153 an the lead 148 of the thermal fuse 146 as illustrated. In this manner, it can be seen that the insulative mass 158 in combination with the insulating sleeve 152 holds and spaces the heater coil 153 from the thermal fuse 146 in a desired manner for the reasons previously set forth.

Figure 27:
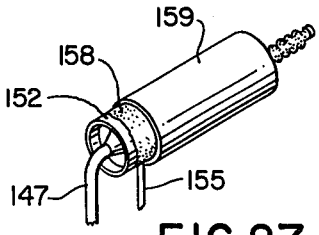
FIG. 27 is a perspective view of the device of FIG. 26 with an insulating sleeve disposed over the first insulating mass thereof.
Figure 28:
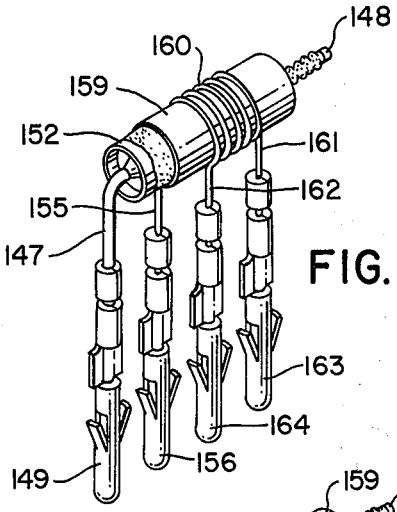
FIG. 28 is a perspective view similar to FIG. 27 and illustrates another heater wire coiled on the outer insulating sleeve.

Thereafter, another insulating sleeve 159 can be telescoped over the mass covered coiled heater wire 153 in the manner illustrated in FIG. 27 so as to permit another heater wire 160 of FIG. 28 to be coiled thereon and thereby be further spaced from the thermal fuse 146 by a distance equal to the thickness of the two sleeves 152 and 159 as well as by the spacing and securing mass 158 previously described.

Figure 22:
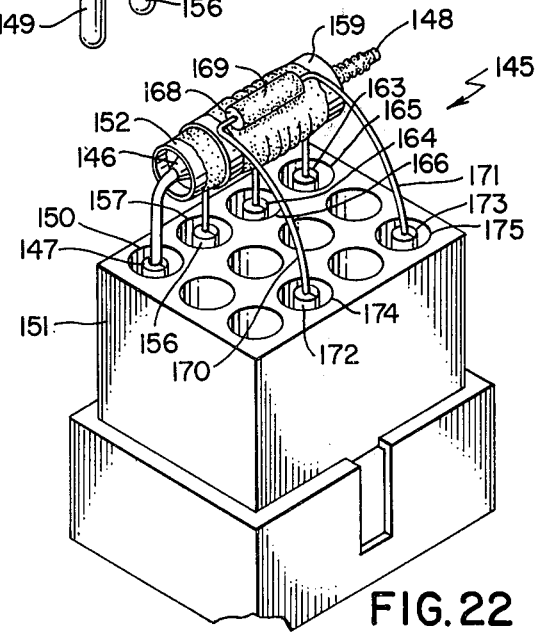
FIG. 22 is a perspective view of another thermal limiter construction of this invention wherein a plurality of heater means are secured in different spaced relations relative to the fuse by an insulating mass.

The opposed ends 161 and 162 of the coiled heater wire 160 are respectively interconnected to plug-in elements 163 and 164 respectively being adapted to be disposed in holes 165 and 166 of the plug-in terminal block 151 as illustrated in FIG. 22, whereby the heater wire 160 would be responsive to an electrical circuit placed across the plug-in terminals 163 and 164.

Figure 29:
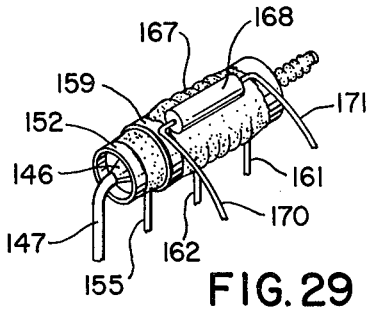
FIG. 29 is a perspective view similar to FIG. 28 and illustrates a covering mass over the outer coiled heater wire and another heater device being disposed against such outer insulating mass covered heater wire.

After the heater wire 160 has been coiled on the sleeve 159 in the manner illustrated in FIG. 28, the coiled portion thereof is covered by another insulating mass 167 in the manner illustrated in FIG. 29 so as to secure and hold the heater wire 160 in the position illustrated in FIG. 28.

If desired, another heater wire or resistance element 168 can then be positioned against the mass covered outer coiled heater wire 160 in the manner illustrated in FIG. 29 and be subsequently secured thereto by another insulating mass 169 in the manner illustrated in FIG. 22.

The heater wire or resistance element 168 has the opposed leads 170 and 171 thereof respectively interconnected to the plug-in terminals 172 and 173 adapted to be disposed in holes 174 and 175 of the terminal block 151 in the manner illustrated in FIG. 22 whereby it can be seen that the resistance member 168 is spaced from the thermal fuse 146 by the distance comprising the thickness of the sleeves 152, 159 and the covering insulative masses 158 and 167.

Thus, the three heater means 153, 160 and 168 are held in different positions relative to the thermal fuse 146 by the insulating masses 158, 167 and 169 so that, in effect, the heater means are in different stratified positions relative to the fuse 146 for the reasons previously set forth.

While all of the previously described thermal limiter constructions of this invention have the heater means and the thermally responsive device therefor secured in a selected positioning thereof by an insulating mass, it is to be understood that a thermal limiter construction of this invention can be provided wherein the selected positioning of the heater means and the thermally responsive device are maintained by means other than the insulating mass even though the insulating mass could additionally be utilized, if desired.

Figure 32:
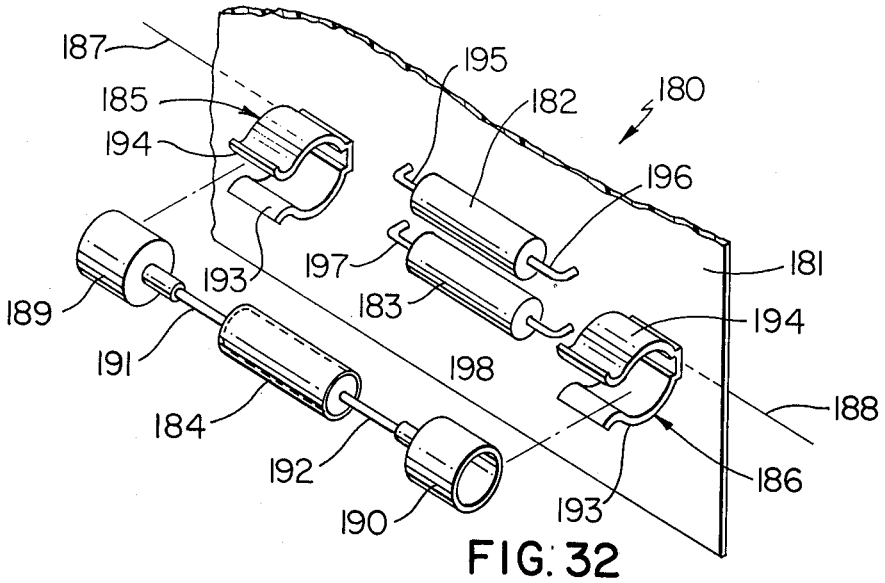
FIG. 32 is a view similar to FIG. 30 and illustrating the thermally responsive device before the same is assembled in position.
Figure 31:
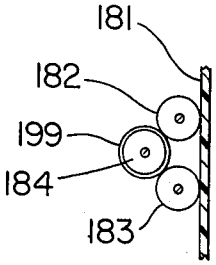
FIG. 31 is a cross-sectional view taken on line 31—31 of FIG. 30.
Figure 30:
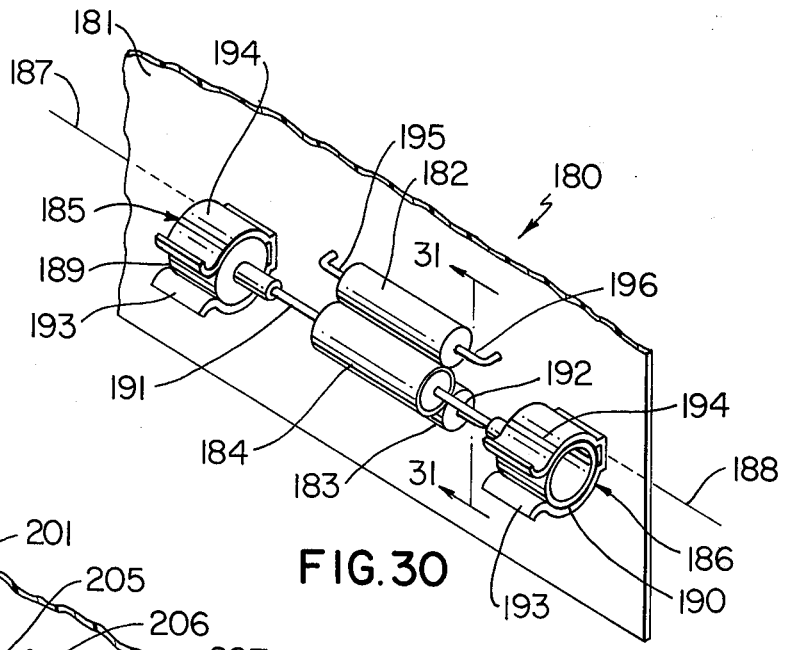
FIG. 30 is a fragmentary perspective view of another thermal limiter construction of this invention.

For example, reference is now made to FIGS. 30–32 wherein another thermal limiter construction of this invention is generally indicated by the reference numeral 180 and comprises an electrically insulating support means 181 for supporting a plurality of electrically operated heater means 182 and 183 in fixed positions relative to a thermally responsive device 184 that is also supported on the support means 181.

The support means 181 can carry conductive spring clips 185 and 186 respectively electrically interconnected to lead means 187 and 188 comprising an electrical circuit that is to be protected by the thermally responsive device 184, which can be of the fuse type previously described and has conductive cylindrical ferrules 189 and 190 secured to the outer ends of the opposed conductors 191 and 192 of the thermally responsive device 184 so as to readily permit the same to be detachably secured to the spring clips 185 and 186 by being snap fitted between the opposed spring legs 193 and 194 thereof in the manner illustrated in FIGS. 30 and 32.

Thus, it can be seen that when the thermally responsive device 184 has its conductive ferrules 189 and 190 respectively snap fitted to the spring clips 185 and 186, the thermally responsive device 184 is disposed in series between the leads 187 and 188 to protect the circuit thereof should one or more of the heater means 182 and 183 be operating for a certain amount of time to heat and thereby cause the fuse or thermally responsive device 184 to open the circuit therethrough in the manner previously described.

The electrical heater means 182 and 183 illustrated in FIGS. 30–32 comprise cylindrical, carbon resistance devices respectively having their longitudinal axes supported in a spaced apart parallel relation by having the leads 195, 196 and 197 and 198 thereof secured to the support means 181 in the manner illustrated so that the thermally responsive device 184, when having its ferrules 189 and 190 properly inserted in the spring clips 185 and 186, will nest in abutting contact between the heater means 182 and 183 in the manner illustrated in FIG. 31. Thus, it can be seen that the thermally responsive device 184 is also substantially cylindrical and has its longitudinal axis parallel with the longitudinal axes of the heater means 182 and 183.

Figure 24:
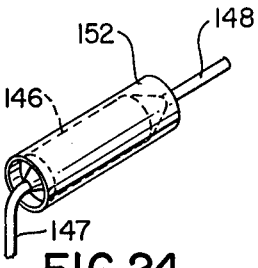
FIG. 24 is a perspective view of the device of FIG. 23 with an insulating sleeve disposed over the same.

If desired, an insulative sleeve 199 can be disposed over the thermally responsive device 184 in the same manner that the sleeve 152 is disposed over the thermally responsive device 146 of the embodiment illustrated in FIG. 24.

The operation of the thermal limiter construction 180 will now be described.

As long as the thermally responsive device 184 is electrically interconnecting the leads 187 and 188 together, the circuit comprising the leads 187 and 188 can continue to operate but should one or both of the heater means 182 and 183 be electrically operated for a certain length of time so that the heat thereof causes the thermally responsive device 184 to open, the thus opened thermally responsive device 184 will terminate the operation of the electrical circuit being protected thereby.

Accordingly, if the thermally responsive device 184 is a fuse that blows when heated to a certain degree by one or more of the heater means 182 and 183, then such blown thermally responsive device 184 must be removed from the support means 181 and a new thermally responsive device 184 must be replaced therefor before the circuit means 187, 188 can be operated in the manner previously described.

Thus, by having the ferrules 189 and 190 on the conductors 191 and 192 of the thermally responsive device 184, such arrangement together with the spring clips 185 and 186 readily permits the support means 181 to detachably support the thermally responsive device 184 in the proper position for sensing the heat of the heater means 182 and 183 should the same subsequently be turned on.

Of course, it is to be understood that if it is desired to place an insulating mass over the arrangement illustrated in FIG. 30, such insulating mass can be provided if desired for the reasons previously set forth.

Further, while the arrangement of the heater means 182 and 183 and the thermally responsive device 184 in the embodiment of FIGS. 30–32 all have the longitudinal axes thereof disposed parallel to each, it is to be understood that the heater means could be arranged in different directions if desired.

Figure 33:
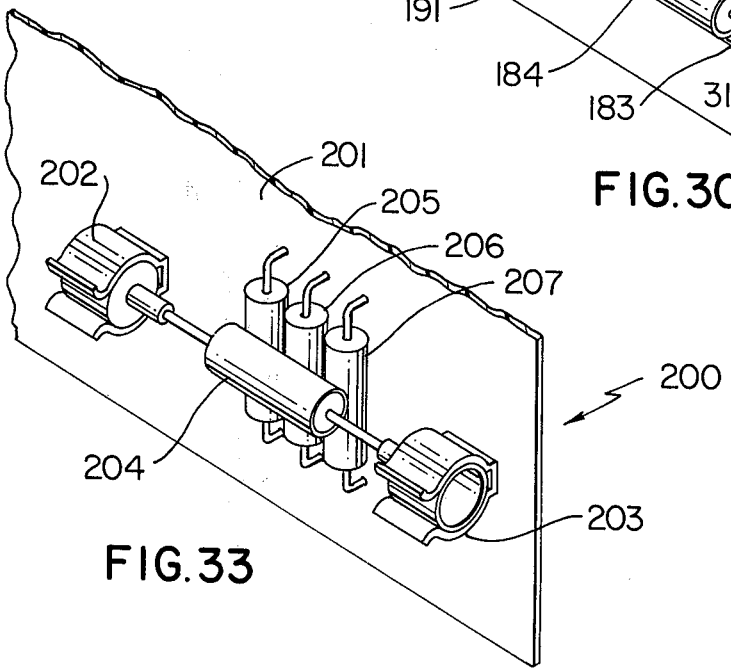
FIG. 33 is a view similar to FIG. 30 and illustrates another thermal limiter construction of this invention.
Figure 35:
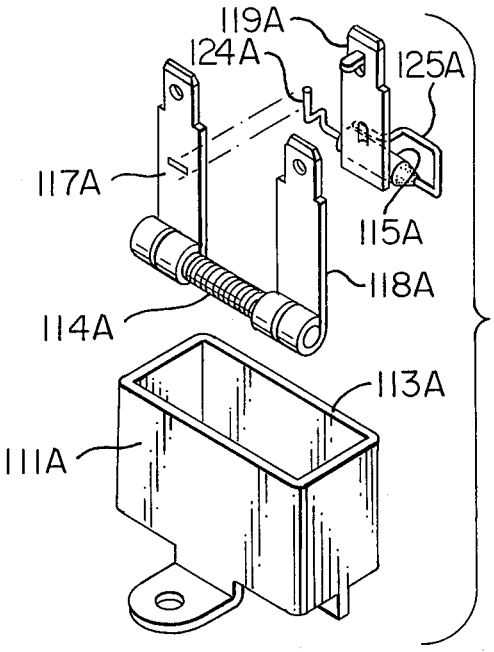
FIG. 35 is an exploded perspective view of the various parts forming the thermal limiter construction of FIG. 34.
Figure 36:
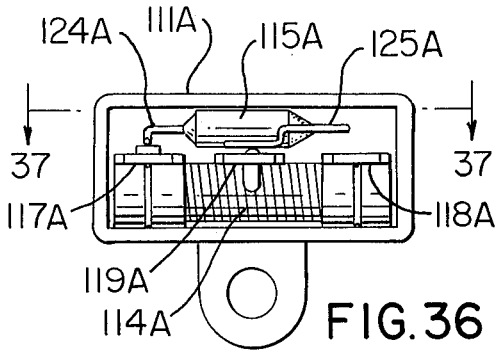
FIG. 36 is a top view of the parts of FIG. 35 in their assembled position with an insulating mass of the thermal limiter construction removed.

For example, reference is now made to FIG. 33 wherein another thermal limiter construction of this invention is generally indicated by the reference numeral 200 and comprises a support plate 201 and spring clips 202 and 203 for carrying a thermally responsive device 204 on the support means 201 for the same purpose that the thermally responsive device 184 was carried on the support means 181 previously described. However, the plurality of electrically operated cylindrical heater means 205, 206 and 207 of the thermal limiter construction 200 illustrated in FIG. 33 all have their axes disposed parallel to each other in an aligned side-by-side arrangement and transverse to the longitudinal axis of the thermally responsive device 204 while still being disposed in abutting relation therewith.

Thus, it can be seen that the thermally responsive device 204 is adapted to be activated by the heat from one or more of the heater means 205, 206 or 207 to open the circuit being protected by the device 204 should the device 204 be heated a certain amount.

While it has been stated throughout the previous description of the various embodiments of this invention that the device sensing the heat of the various heater means, whether the same be wires or resistors, is a thermally responsive fuse which blows when sensing a certain temperature for a certain period of time, it is to be understood that such fuse could be merely a thermally responsive thermostat which when heated to a certain temperature will open an electrical circuit, but when subsequently cooled, will again complete the electrical circuit so that the same will not be a throw-away device once the circuit has been opened thereby, but still would be a thermal limiter under the control of the various heaters being secured thereto by the insulative mass for the reasons previously set forth.

Therefore, the term "thermally responsive device" is intended to cover not only fuses, thermostats, etc., but also other means for opening circuits through the sensing of a certain temperature for a certain desired period of time whether such time period be substantially instantaneous or delayed.

Further, while the term "heater wires" is utilized throughout this description for the various embodiments of the thermal limiters of this invention, it is to be understood that the heater wires could be merely other forms of resistors and not necessarily just wires themselves.

In view of the above, it can be seen that this invention not only provides an improved thermal limiter wherein a controlled time delay thereof is provided by selective positioning of the heating means and the fuse together with the desired heat conductive characteristics of the securing mass, but also this invention provides an improved method of making such a thermal limiter or the like.

While the forms and methods of this invention have been described and illustrated as required by the Patent Statutes, it is to be understood that other forms and methods can be utilized and still come within the scope of the appended claims.

What is claimed is:

1. A self contained thermal limiter construction for at least one electrical circuit comprising a thermally responsive device; an electrical heater means disposed in a selected position relative to said device; three blade-like lead members having their narrow dimension disposed in aligned relation along a substantially straight line with one of said lead members being operatively interconnected to one end of each of said device and said heater means and the other two lead members being respectively operatively interconnected to the other ends of said device and said heater means; a cup-shaped, rectangular housing having an open end receiving said heater means and said device therein with all of said lead members having at least portions thereof exposed from said housing, and an insulating mass covering and securing said heater means without contacting said device, whereby said selected positioning provides a controlled time delay between application of electrical current to said heater means and actuation of said device for opening of said electrical circuit.

2. A self-contained thermal limiter construction as set forth in claim 1 wherein said device is disposed intermediate and spaced from said open end of said housing and said insulating mass in said housing.

* * * * *